US011350699B2

(12) United States Patent
Kim

(10) Patent No.: US 11,350,699 B2
(45) Date of Patent: Jun. 7, 2022

(54) ORTHOTIC ARCH SUPPORT DEVICE AND METHOD OF USE

(71) Applicant: Richard Kim, Gansevoort, NY (US)

(72) Inventor: Richard Kim, Gansevoort, NY (US)

( * ) Notice: Subject to any disclaimer, the term of this patent is extended or adjusted under 35 U.S.C. 154(b) by 0 days.

(21) Appl. No.: 16/029,090

(22) Filed: Jul. 6, 2018

(65) Prior Publication Data

US 2020/0008522 A1 Jan. 9, 2020

(51) Int. Cl.

| | |
|---|---|
| ***A43B 17/02*** | (2006.01) |
| ***A43B 7/142*** | (2022.01) |
| ***A43B 17/14*** | (2006.01) |
| ***A43B 7/1405*** | (2022.01) |
| ***A43B 13/18*** | (2006.01) |

(52) U.S. Cl.

CPC ..... *A43B 17/02* (2013.01); *A43B 7/142* (2013.01); *A43B 17/14* (2013.01); *A43B 7/141* (2013.01); *A43B 13/181* (2013.01)

(58) Field of Classification Search

CPC ..... A43B 17/02; A43B 17/023; A43B 17/03; A43B 17/026; A43B 7/142; A43B 17/14; A43B 7/141; A43B 13/181; A43B 7/149; A43B 7/1445; A43B 7/1465; A43B 7/1405

USPC ..... 36/43, 91

See application file for complete search history.

(56) References Cited

U.S. PATENT DOCUMENTS

| | | | | |
|---|---|---|---|---|
| 717,523 | A | 1/1903 | Arrowsmith | |
| 1,853,998 | A | 4/1932 | Sadler | |
| 3,339,555 | A | 9/1967 | Rotko | |
| 4,441,499 | A | 4/1984 | Comparetto | |
| 5,224,277 | A | 7/1993 | Sang Do | |
| 5,311,680 | A | 5/1994 | Comparetto | |
| 5,903,985 | A | 5/1999 | DeMarchi | |
| 6,105,283 | A | 8/2000 | Park | |
| 6,345,455 | B1 | 2/2002 | Greer, Jr. | |
| 6,510,626 | B1 | 1/2003 | Greenawalt | |
| 7,430,820 | B2 * | 10/2008 | Andreoli | A43B 7/1495 36/140 |

(Continued)

FOREIGN PATENT DOCUMENTS

| | | |
|---|---|---|
| CN | 1182559 | 5/1998 |
| CN | 1232653 | 10/1999 |

(Continued)

OTHER PUBLICATIONS

International Search Report and Written Opinion of the International Searching Authority for PCT/US2019/040651, dated Jan. 29, 2020, 15 pages.

(Continued)

*Primary Examiner* — Khoa D Huynh
*Assistant Examiner* — Aiying Zhao
(74) *Attorney, Agent, or Firm* — Heslin Rothenberg Farley & Mesiti P.C.; Jacquelyn A. Graff, Esq.

(57) ABSTRACT

Orthotic devices for providing arch support for the foot are disclosed. The orthotic device includes a base member, an arch support portion, and a covering for coupling the arch support portion to the base member. A method of providing continuous contact with the plantar surface of the foot during all phases of the gait cycle is also disclosed. In addition, methods of assembling and using the orthotic device are also disclosed.

13 Claims, 5 Drawing Sheets

(56) References Cited

U.S. PATENT DOCUMENTS

| | | | | |
|---|---|---|---|---|
| 8,745,894 | B2 * | 6/2014 | Cheskin | A43B 1/0009 36/3 R |
| 9,345,286 | B2 | 5/2016 | Holt et al. | |
| 2008/0127526 | A1 | 6/2008 | Spicer | |
| 2008/0313927 | A1 | 12/2008 | Conforti | |
| 2009/0071038 | A1 | 3/2009 | Luthi | |
| 2009/0265956 | A1 | 10/2009 | Richards | |
| 2010/0005566 | A1 | 1/2010 | Gabe | |
| 2010/0064550 | A1 * | 3/2010 | Kahn | A43B 3/0031 36/91 |
| 2010/0269375 | A1 | 10/2010 | Georgoulakis | |
| 2011/0288446 | A1 | 11/2011 | Hsieh | |
| 2011/0302805 | A1 * | 12/2011 | Vito | A43B 7/142 36/44 |
| 2012/0246971 | A1 | 10/2012 | Donzis | |
| 2012/0317843 | A1 | 12/2012 | Bove | |
| 2017/0055629 | A1 * | 3/2017 | Schickling | A43B 7/1445 |
| 2017/0099907 | A1 * | 4/2017 | Cin | A43B 1/0009 |
| 2017/0258176 | A1 | 9/2017 | Waatti et al. | |
| 2019/0021438 | A1 * | 1/2019 | Salkavich | A43B 7/24 |

FOREIGN PATENT DOCUMENTS

| | | | | |
|---|---|---|---|---|
| CN | 101083921 | | 12/2007 | |
| CN | 101801228 | | 8/2010 | |
| DE | 19603755 | | 8/1997 | |
| DE | 202009015388 | | 12/2010 | |
| EP | 0409101 | | 1/1991 | |
| EP | 0464000 | | 1/1992 | |
| JP | 10127305 | | 5/1998 | |
| KR | 100755029 | | 9/2007 | |
| WO | 1997041747 | | 11/1997 | |
| WO | WO-9741747 | A1 * | 11/1997 | A43B 17/00 |
| WO | 1998052435 | | 11/1998 | |
| WO | 2015112471 | | 7/2015 | |
| WO | 2016191505 | | 12/2016 | |

OTHER PUBLICATIONS

CS&E PCT Collaborative Search and Examination Pilot Upload Peer Contribution in International Patent Application No. PCT/US2019/040651, Peer ISA—Korean Intellectual Property Office (KIPO), dated Sep. 24, 2019, 17 pages.

CS&E PCT Collaborative Search and Examination Pilot Upload Peer Contribution in International Patent Application No. PCT/US2019/040651, Peer ISA—China National Intellectual Property Administration (CNIPA), dated Sep. 19, 2019, 11 pages.

CS&E PCT Collaborative Search and Examination Pilot Upload Peer Contribution in International Patent Application No. PCT/US2019/040651, Peer ISA—European Patent Office (EPO), dated Sep. 26, 2019, 12 pages.

CS&E PCT Collaborative Search and Examination Pilot Upload Peer Contribution in International Patent Application No. PCT/US2019/040651, Peer ISA—Japan Patent Office (JPO), dated Sep. 19, 2019, 9 pages.

Extended European Search Report issued in European Patent Application No. 19830622.7, dated Mar. 17, 2022, 7 pages.

* cited by examiner

ORTHOTIC ARCH SUPPORT DEVICE AND METHOD OF USE

TECHNICAL FIELD

The present disclosure relates generally to the podiatric, orthopedic, orthotic and footwear fields related to providing arch support for the foot. More specifically, but not exclusively, the present disclosure relates to devices and methods for providing continuous contact with the plantar surface of the foot during all phases of the gait cycle.

BACKGROUND OF THE INVENTION

Most solutions for providing arch support are either rigid and provide a structured system without foot flexibility or flexible and unable to provide plantar support. Device that are rigid and/or uniform are adept to stationary activities, such as, standing, but do not provide support when the user is active as they remain linear to the plantar aspect of the foot. Flexible or softer insole devices allow for increased flexibility, but do not provide sufficient plantar and arch support. Thus, new and improved arch support devices and methods for using the devices are needed to provide both foot and sole flexibility while also providing increased plantar and arch support.

SUMMARY OF THE INVENTION

The present disclosure is directed toward devices and methods for providing continuous contact with the plantar surface of the foot during all phases of the gait cycle.

In one aspect of the present disclosure provided herein, is an orthotic device. The orthotic device including a base member, an arch support portion, and a covering coupling the arch support portion to the base member.

In another aspect of the present disclosure provided herein, is a method of assembling an orthotic device. The method includes obtaining a plurality of arch members. The method also includes positioning the plurality of arch members within a covering. Finally, the method includes coupling the covering containing the plurality of arch members to the base member.

These and other objects, features and advantages of this disclosure will become apparent from the following detailed description of the various aspects of the disclosure taken in conjunction with the accompanying drawings.

BRIEF DESCRIPTION OF THE DRAWINGS

The accompanying drawings, which are incorporated in and constitute a part of the specification, illustrate embodiments of the disclosure and together with the detailed description herein, serve to explain the principles of the disclosure. It is emphasized that, in accordance with the standard practice in the industry, various features are not drawn to scale. In fact, the dimensions of the various features may be arbitrarily increased or reduced for clarity of discussion. The drawings are only for purposes of illustrating preferred embodiments and are not to be construed as limiting the disclosure.

DETAILED DESCRIPTION FOR CARRYING OUT THE INVENTION

Figure 1:
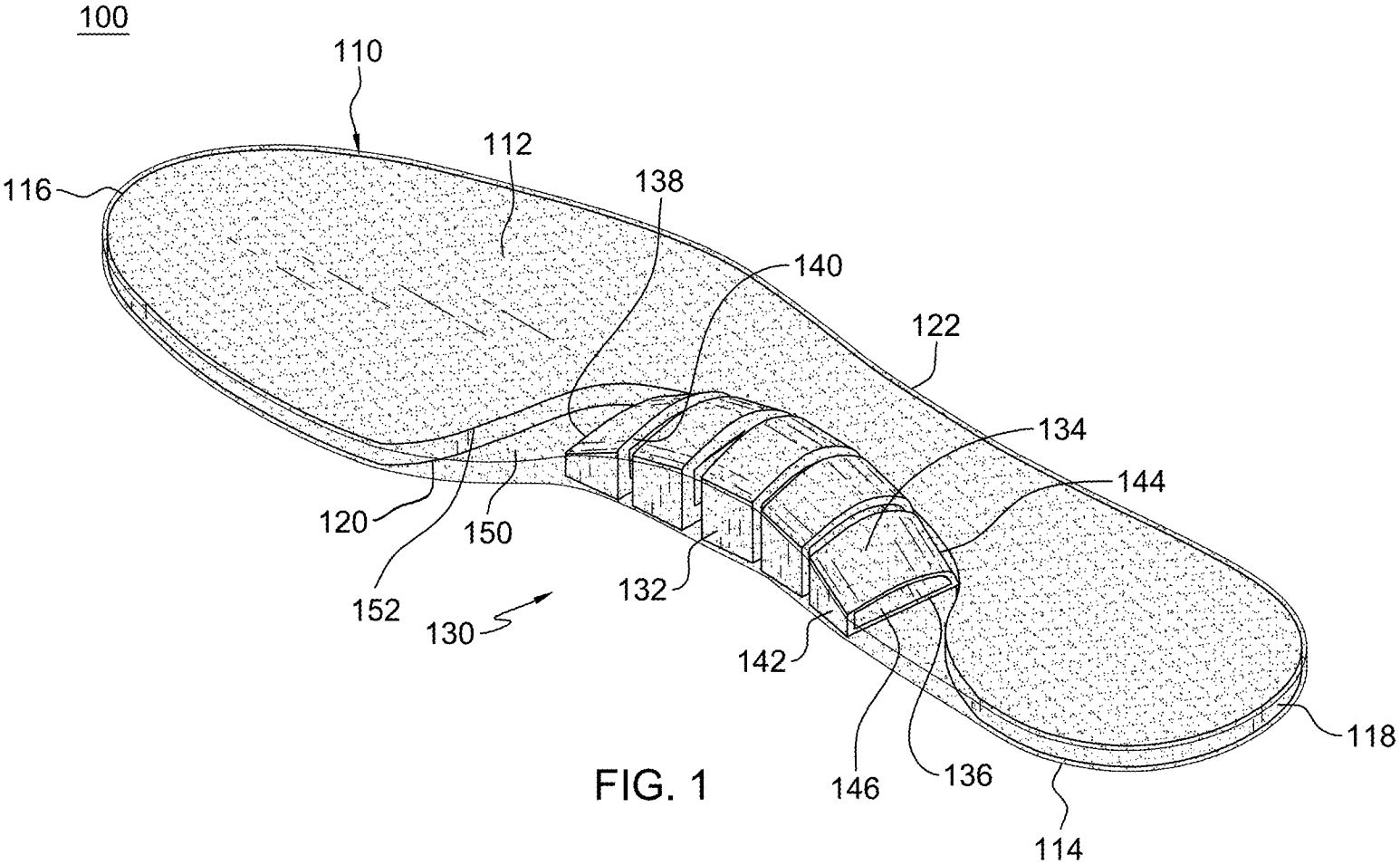
FIG. 1 is a perspective view of one embodiment of an orthotic device, in accordance with an aspect of the present disclosure.

Generally stated, disclosed herein are devices for providing arch support for the foot. Further, methods for using the devices to provide continuous contact with the plantar surface of the foot during all phases of the gait cycle are discussed.

In this detailed description and the following claims, the words proximal, distal, anterior or plantar, posterior or dorsal, medial, lateral, superior and inferior are defined by their standard usage for indicating a particular part or portion of a bone or implant according to the relative disposition of the natural bone or directional terms of reference. For example, "proximal" means the portion of a device nearest the torso, while "distal" indicates the portion of the device farthest from the torso. As for directional terms, "anterior" is a direction towards the front side of the body, "posterior" means a direction towards the back side of the body, "medial" means towards the midline of the body, "lateral" is a direction towards the sides or away from the midline of the body, "superior" means a direction above and "inferior" means a direction below another object or structure. Further, specifically in regards to the foot, the term "dorsal" refers to the top of the foot and the term "plantar" refers the bottom of the foot.

Similarly, positions or directions may be used herein with reference to anatomical structures or surfaces. For example, as the current devices and methods are described herein with reference to use with the bones of the foot, the bones of the foot, ankle and lower leg may be used to describe the surfaces, positions, directions or orientations of the devices and methods. Further, the devices and methods, and the aspects, components, features and the like thereof, disclosed herein are described with respect to one side of the body for brevity purposes. However, as the human body is relatively symmetrical or mirrored about a line of symmetry (midline), it is hereby expressly contemplated that the devices and methods, and the aspects, components, features and the like thereof, described and/or illustrated herein may be changed, varied, modified, reconfigured or otherwise altered for use or association with another side of the body for a same or similar purpose without departing from the spirit and scope of the disclosure. For example, the devices and methods, and the aspects, components, features and the like thereof, described herein with respect to the right foot may be mirrored so that they likewise function with the left foot. Further, the devices and methods, and the aspects, components, features and the like thereof, disclosed herein are described with respect to the foot for brevity purposes, but it should be understood that the devices and methods may be used with other bones of the body having similar structures.

Referring to the drawings, wherein like reference numerals are used to indicate like or analogous components throughout the several views, and with particular reference to FIGS. 1-7, there is illustrated an exemplary embodiment of an orthotic device or arch support 100. The orthotic device 100 includes a base member 110, an arch support portion 130, and a covering 150 to moveably couple the arch support portion 130 to the base member 110.

With continued reference to FIGS. 1-7, the base member 110 includes a top or superior side 112 opposite a bottom or inferior side 114, a first or distal end 116 opposite a second or proximal end 118, and a medial side 120 opposite a lateral side 122. The base member 110 may also include a recessed region 126 extending into the base member 110 from the medial side 120. The recessed region 126 also extends from the superior side 112 of the base member 110 to the inferior side 114 of the base member 110. The distance between the recessed region 126 on the medial side 120 and the lateral side 122 may vary to position the arch support portion 130 in the desired location for a given patient and/or a given anatomical pathology. For example, the distance between the recessed region 126 and the lateral side 122 of the base member 110 may be wider or narrower than shown. The base member 110 may be made of, for example, a soft rubber, flexible silicone, or a like material that provides support and flexibility to the plantar side of the foot. The inferior side 114 of the base member 110 may include, for example, a plurality of members (not shown) or a textured surface (not shown). The plurality of members may be, for example, a plurality of hexagonal or polygonal members that allow the base member 110 to deform and return to shape during a wearer's gait cycle. The plurality of members may also be positioned in a lattice matrix (not shown). The superior side 112 of the base member 110 may be, for example, generally flat with contours that match the shape of the foot of the wearer or alternatively, may be, for example, preformed to address anatomical pathologies of the wearer.

The arch support portion 130 includes a plurality of arch members 132, as shown in FIGS. 1-5. Each arch member 132 of the plurality of arch members 132 may include, for example, a top or superior portion 134, a bottom or inferior portion 136, a first or distal end 138, a second or proximal end 140, a medial side 142, and a lateral side 144, as shown in FIGS. 1 and 2A. The superior portion 134 of the arch members 132 may be, for example, arced or curved between the medial side 142 and the lateral side 144 of the arch members 132. The superior portion 134 of the arch members 132 may be, for example, arced or curved in a convex orientation, a concave orientation, or a combination of convex and concave orientations between the medial side 142 and the lateral side 144. The lateral side 144 may also be, for example, arced or curved as it extends between the superior portion 134 and the inferior portion 136 of the arch members 132. The inferior portion 136 may be, for example, relatively planar or flat as it extends between the medial side 120 and the lateral side 122. The medial side 142 may also be, for example, relatively planar or flat as it extends between the superior portion 134 and the inferior portion 136 of the arch members 132. In addition, at least one first arch member 132 may be, for example, tapered in a distal to proximal direction between the first and second ends 138, 140 of the arch member 132, and at least one second arch member 132 may be, for example, tapered in a proximal to distal direction between the first and second ends 138, 140. In an embodiment, the center arch member 132 may be, for example, planar or flat in a proximal-distal direction, i.e. may not be tapered. Although shown as an odd number of arch members 132, i.e., five arch members 132, the arch support portion 130 may have, for example, any number of arch members 132, which may be an odd or even number of arch members 132, as needed to provide continuous contact with the plantar surface of the foot with any given anatomical pathology.

Each arch member 132 may also include an opening or hollow portion 146 extending from the first or distal end 138 to the second or proximal end 140 of each arch member 132. The size and shape of the hollow portion 146 may be selected, for example, to provide the desired support and flexibility for a patient's plantar arch through the entire gait cycle. The edges of the hollow portion 146 of each arch member 132 may form, for example, a rimmed edge around the perimeter of each arch member 132 on the first and second ends 138, 140. The rimmed edge of the arch members 132 may be, for example, rounded, curved, smooth or the like to allow for each arch member 132 to translate with respect to the adjacent arch members 132. The plurality of arch members 132 may be, for example, collated or positioned relative to each other to form the shape of the arch of the foot. For example, the plurality of arch members 132 includes a first end arch member 132, a plurality of intermediate arch members 132, and a second end arch member 132, the first end 138 of each of the plurality of intermediate arch members 132 and the second end arch member 132 is separate from the second end 140 of each adjacent arch member 132 of the first end arch member 132 and the plurality of intermediate arch members 132. The plurality of arch members 132 may, for example, align in a resting state, as shown in FIGS. 1-7, to form the arch support portion 130 of the orthotic device 100. Alternatively, the arch members 132 may be, for example, offset such that they are positioned in a non-linear planar orientation, as needed to provide continuous contact with the plantar surface of the wearer's foot. For example, the plurality of arch members 132 includes a first end arch member 132, a plurality of intermediate arch members 132, and a second end arch member 132 with the first end 138 of each intermediate arch member 132 of the plurality of arch members 132 and the second end arch member is positioned next to the second end 140 of the first end arch member 132 and each adjacent intermediate arch member 132 of the plurality of arch members 132 in a first position and each arch member 132 of the plurality of arch members 132 is positioned at least partially overlapping each adjacent arch member 132 of the plurality of arch members 132 in a second position. In addition, the planes of each arch member 132 may be, for example, positioned generally perpendicular to the recessed region 126 of the base member 110, or alternatively, the planes of each arch member 132 may be, for example, positioned at varying angles relative to the recessed region 126 of the base member 110. The position of the planes of each arch member 132 relative to the recessed region 126 of the base member 110 may be selected to provide continuous contact with the plantar surface of the wearer's foot for a given anatomical pathology. The arch support portion 130 may be, for example, semi-flexible. The arch members 132 may be, for example, made of slices of plastic or a like material that provide the desired support for the arch of a patient's foot and also the desired flexibility to move during the gait cycle.

Figure 2:
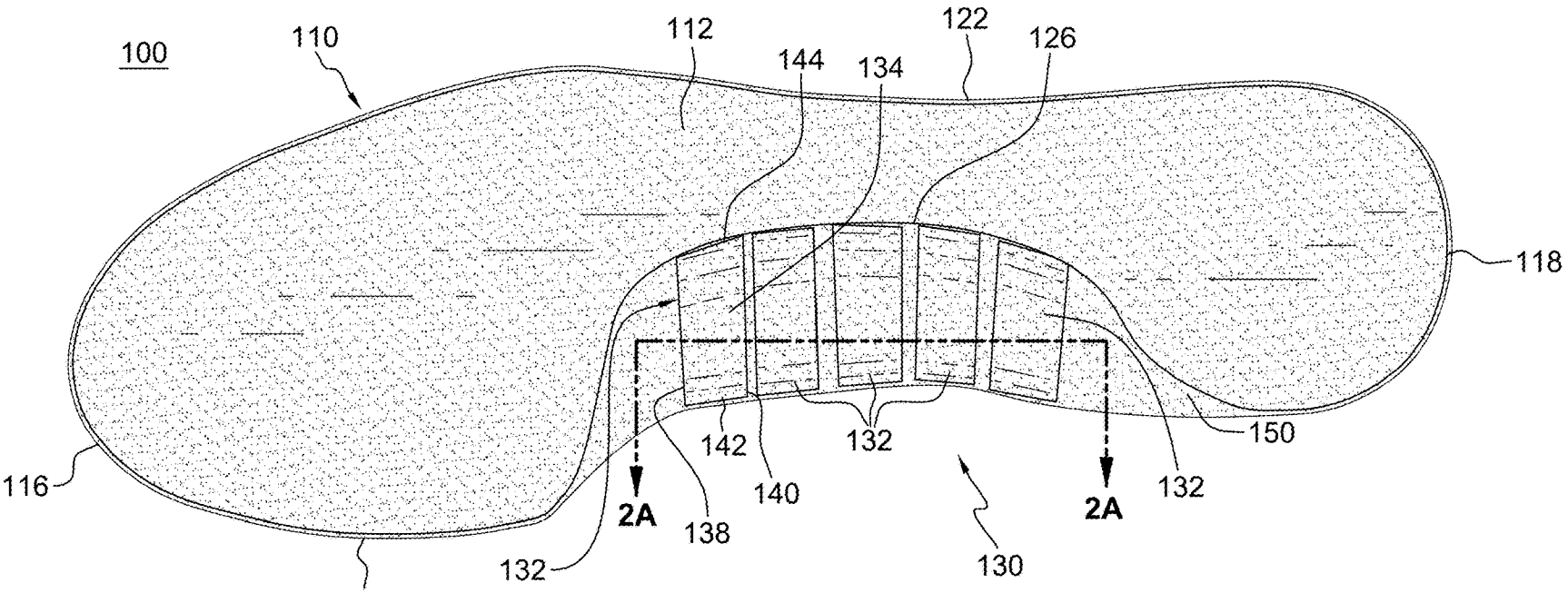
FIG. 2 is a dorsal view of the orthotic device of FIG. 1, in accordance with an aspect of the present disclosure.
Figure 2A:
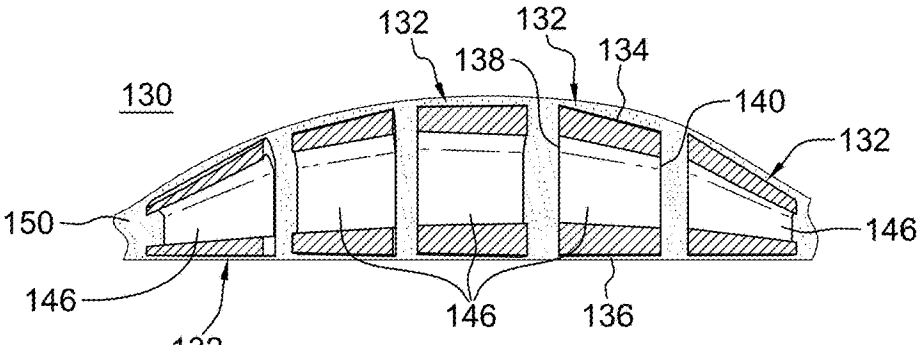
FIG. 2A is a cross-sectional view taken along line 2A-2A in FIG. 2, in accordance with an aspect of the present disclosure.
Figure 3:
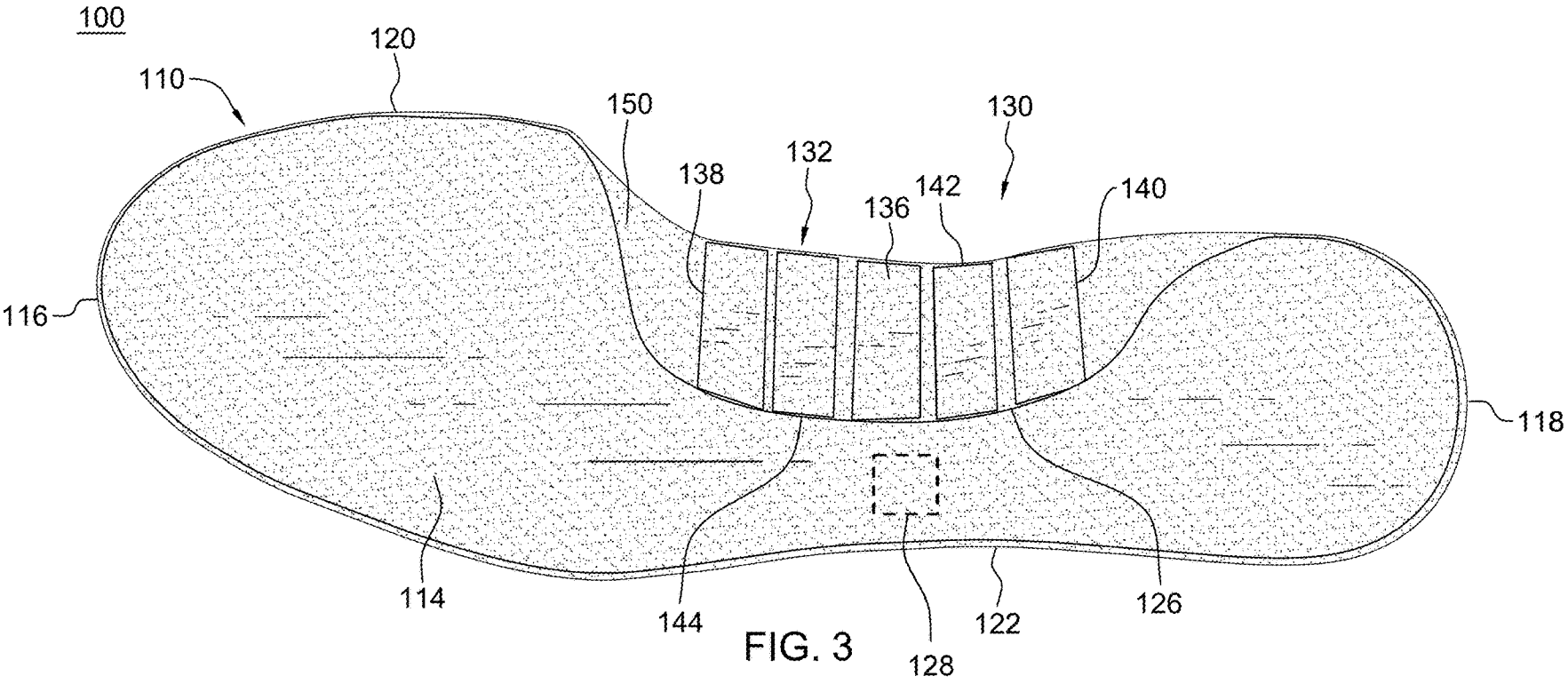
FIG. 3 is a plantar view of the orthotic device of FIG. 1, in accordance with an aspect of the present disclosure.
Figure 4A:
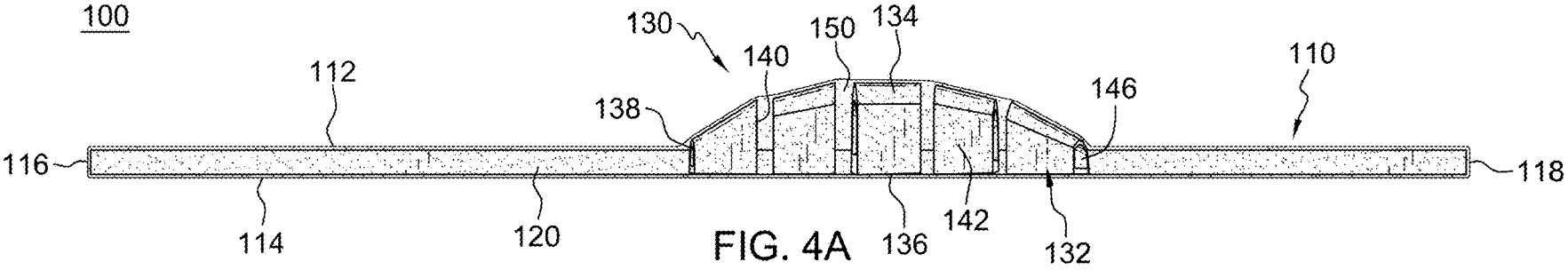
FIG. 4A is a medial view of the orthotic device of FIG. 1, in accordance with an aspect of the present disclosure.
Figure 4B:
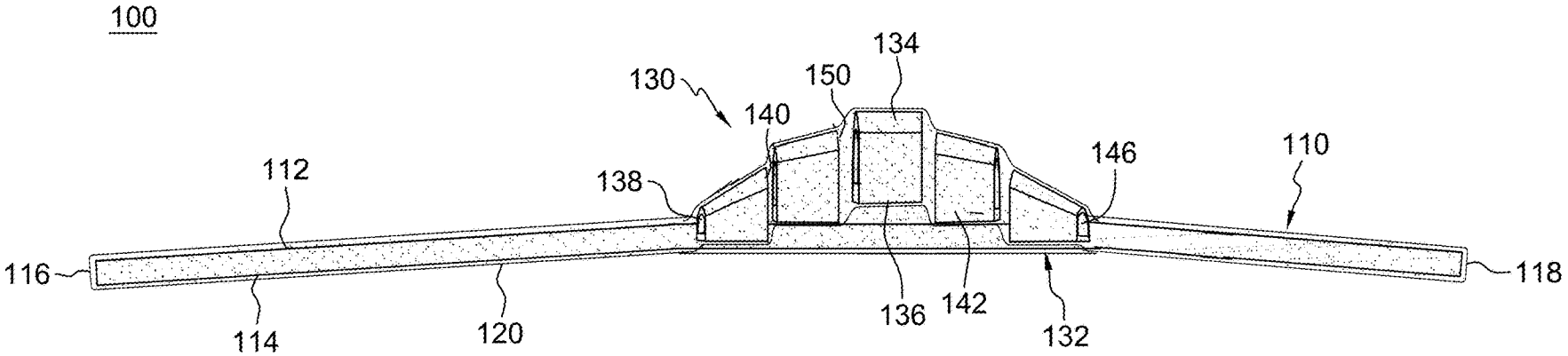
FIG. 4B is a medial view of the orthotic device of FIG. 1, during a mid-swing stance phase of the gait cycle, in accordance with an aspect of the present disclosure.
Figure 5:
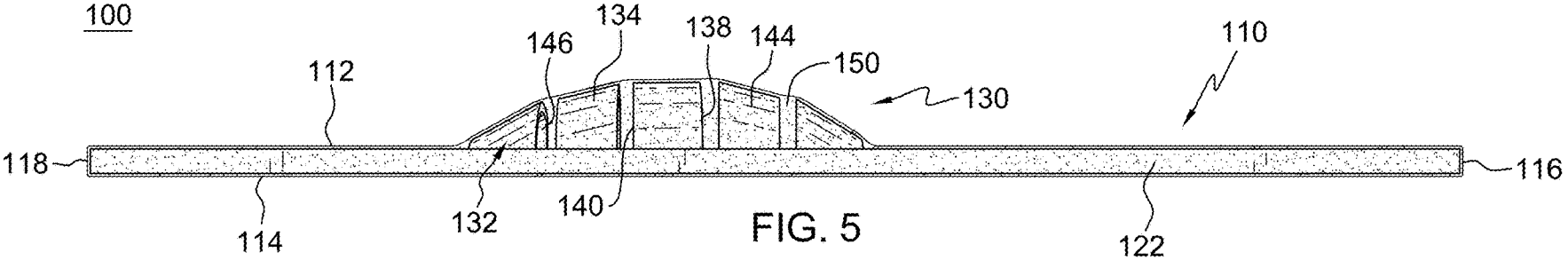
FIG. 5 is a lateral view of the orthotic device of FIG. 1, in accordance with an aspect of the present disclosure.
Figure 7:
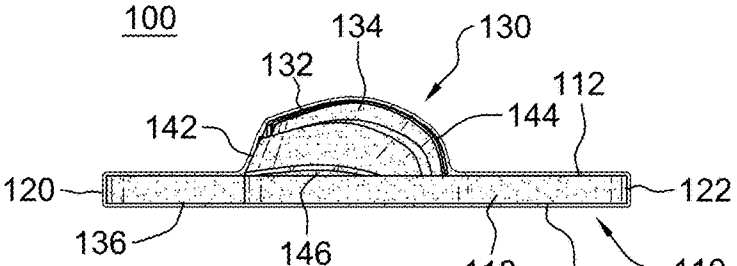
FIG. 7 is a proximal view of the orthotic device of FIG. 1, in accordance with an aspect of the present disclosure.
Figure 6:
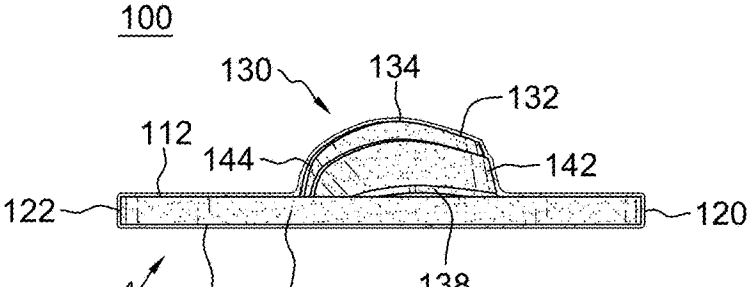
FIG. 6 is a distal view of the orthotic device of FIG. 1, in accordance with an aspect of the present disclosure.

As shown in FIGS. 1-3, the lateral side 144 of each arch member 132 is positioned separate from and adjacent to the medial side 120 of the base member 110 in a recessed region 126. The arch members 132 may, for example, directly contact at least a portion of the medial side 120 of the base member 110 or be spaced apart from the base member 110. The arch members 132 may also be positioned to correspond to the position of a patient's foot arch when the plantar side of the foot contacts the base member 110. The arch members 132 may also be positioned, for example, at the most lateral portion of the arch. The arch members 132 may be, for example, coupled to or secured to the base member 110 by a covering 150, such as an elastic covering or deformable covering 150. For example, each arch member 132 of the plurality of arch members 132 is completely separated from each other arch member 132 of the plurality of arch members 132 when contained within the covering 150. The covering 150 may be secured to the base member 110 by, for example, coupling or sealing the covering 150 to a rim (not shown) of the base member 110. The covering 150 may be, for example, sealed into a rubber rim on the medial side or edge 120 of the base member 110 and the rim may be inset into the base member 110. For illustration purposes, the location of the rim on the medial side or edge 120 in the recessed region is shown as reference number 152. The covering 150 surrounds or encases the arch members 132 to retain order and shape of the arch support portion 130. For example, at least a portion of the covering 150 is sealed to the rim 152 of the base member 110 positioned in the recessed region 126 of the base member 110 forming a first cover portion extending from the superior side 112 of the base member 110 across the top portion 134 of the arch members 132, a second cover portion extending from the top portion 134 of the arch members 132 to the bottom portion 136 of the arch members 132, and a third cover portion extending across the bottom portion 136 of the arch members 132 to the inferior side 114 of the base member 110. The first cover portion, the second cover portion, and the third cover portion create an opening for the plurality of arch members 132 to be surrounded by the covering 150. The covering 150 also allows for the arch members 132 to form the arch support portion 130 of the orthotic device 100 and also to move with respect to the other arch members 132. In addition, the covering 150 may allow for the arch members 132 to overlap with the adjacent arch members 132 as the shape of the foot arch changes during a person's gait cycle. The covering 150 may be made of, for example, an elastic fabric material or another material that stretches and is flexible.

A method of using the orthotic device 100 is also disclosed. The method includes the plurality of arch members 132 aligning to provide consistent segmental pressure to the arch, primarily, the plantar fascia, during the flat foot and mid stance phase of the gait cycle. Next, during the heel off and toe off phases of the gait cycle, the plurality of arch members 132 slide past the neighboring or adjacent arch members 132 based on the flexion of the foot and the shape change of the sole providing contiguous pressure to the arch/plantar fascia. In this heel off and toe off phase, each arch member of the plurality of arch members is positioned at least partially overlapping each adjacent arch member of the plurality of arch members in a second position. Then, during the mid-swing stance phase of the gait cycle, the plurality of arch members 132 remain in an overlapped arrangement to provide equal segmental pressure to the arch/plantar fascia. Next, during the heel strike phase of the gait cycle, the individual arch members 132 again slide past neighboring or adjacent arch members 132 corresponding to the change in shape of the sole providing contiguous pressure on the arch/plantar fascia. Finally, during the flat foot and mid stance phase of the gait cycle, the plurality of arch members 132 realign to allow the plurality of arch members 132 to repeat the movement cycle.

As may be recognized by those of ordinary skill in the art based on the teachings herein, numerous changes and modifications may be made to the above-described and other embodiments of the present disclosure without departing from the scope of the disclosure. The components of the device as disclosed in the specification, including the accompanying abstract and drawings, may be replaced by alternative component(s) or feature(s), such as those disclosed in another embodiment, which serve the same, equivalent or similar purpose as known by those skilled in the art to achieve the same, equivalent or similar results by such alternative component(s) or feature(s) to provide a similar function for the intended purpose. In addition, the devices may include more or fewer components or features than the embodiments as described and illustrated herein. Accordingly, this detailed description of the currently-preferred embodiments is to be taken in an illustrative, as opposed to limiting of the disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has", and "having"), "include" (and any form of include, such as "includes" and "including"), and "contain" (and any form of contain, such as "contains" and "containing") are open-ended linking verbs. As a result, a method or device that "comprises," "has," "includes," or "contains" one or more steps or elements possesses those one or more steps or elements, but is not limited to possessing only those one or more steps or elements. Likewise, a step of a method or an element of a device that "comprises," "has," "includes," or "contains" one or more features possesses those one or more features, but is not limited to possessing only those one or more features. Furthermore, a device or structure that is configured in a certain way is configured in at least that way, but may also be configured in ways that are not listed.

The invention has been described with reference to the preferred embodiment. It will be understood that the architectural and operational embodiments described herein are exemplary of a plurality of possible arrangements to provide the same general features, characteristics, and general system operation. Modifications and alterations will occur to others upon a reading and understanding of the preceding detailed description. It is intended that the disclosure be construed as including all such modifications and alterations.

What is claimed is:

1. An orthotic device, comprising:

a base member with a superior side, an inferior side opposite the superior side, a medial side, a lateral side positioned on a side opposite the medial side, a distal end, and a proximal end positioned at an end opposite the distal end, wherein the medial side, the lateral side, the proximal end, and the distal end each extend between the superior side and the inferior side, and wherein a portion of the medial side forms a recessed region extending into the orthotic device from the medial side toward the lateral side and from the superior side to the inferior side;

an arch support portion positioned within the recessed region; and a covering coupling the arch support portion to the base member;

wherein the arch support portion comprises:

a plurality of arch members surrounded by the covering; and wherein the plurality of arch members are separate arch members each having a top portion, a bottom portion opposite the top portion, a first end, a second end opposite the first end, a medial side, and a lateral side opposite the medial side, and wherein each arch member of the plurality of arch members is completely separated from each other arch member of the plurality of arch members when contained within the covering.

2. The orthotic device of claim 1, wherein the inferior side comprises:

a plurality of members positioned in a lattice matrix pattern.

3. The orthotic device of claim 2, wherein each member of the plurality of members has a hexagonal shape.

4. The orthotic device of claim 1, wherein the medial side of the arch members is coupled to the top portion of the arch members on one end and the bottom portion of the arch members on another end; and wherein the lateral side of the arch members is coupled to the top portion of the arch members on one end and the bottom portion of the arch members on another end.

5. The orthotic device of claim 4, wherein the top portion of the arch members is arced between the medial side of the arch members and the lateral side of the arch members and the bottom portion of the arch members is generally planar between the medial side of the arch members and the lateral side of the arch members.

6. The orthotic device of claim 5, wherein the medial side is generally planar between the top portion and the bottom portion and the lateral side is arced between the top portion and the bottom portion.

7. The orthotic device of claim 6, wherein at least one first arch member of the plurality of arch members is tapered in a distal to proximal direction between the first end and the second end and wherein at least one second arch member of the plurality of arch members is tapered in a proximal to distal direction between the first end and the second end.

8. The orthotic device of claim 7, wherein at least one third arch member of the plurality of arch members has a first thickness at the first end and a second thickness at the second end, wherein the first thickness is the same as the second thickness.

9. The orthotic device of claim 4, wherein each arch member of the plurality of arch members further comprises:

an opening extending from the first end to the second end.

10. The orthotic device of claim 4, wherein the plurality of arch members are collated within the covering.

11. The orthotic device of claim 4, wherein the covering is selected from an elastic covering or a deformable covering.

12. The orthotic device of claim 4, wherein at least a portion of the covering is sealed to a rim of the base member positioned in the recessed region of the base member forming a first cover portion extending from the superior side of the base member across the top portion of the arch members, a second cover portion extending from the top portion of the arch members to the bottom portion of the arch members, and a third cover portion extending across the bottom portion of the arch members to the inferior side of the base member, wherein the first cover portion, the second cover portion, and the third cover portion create an opening for the plurality of arch members to be surrounded by the covering.

13. An orthotic device, comprising:

a base member with a superior side, an inferior side opposite the superior side, a medial side, a lateral side positioned on a side opposite the medial side, a distal end, and a proximal end positioned at an end opposite the distal end, wherein the medial side, the lateral side, the proximal end, and the distal end each extend between the superior side and the inferior side, and wherein a portion of the medial side forms a recessed region extending into the orthotic device from the medial side toward the lateral side and from the superior side to the inferior side;

an arch support portion positioned within the recessed region; and a covering coupling the arch support portion to the base member;

wherein the arch support portion comprises:

a plurality of arch members surrounded by the covering; and wherein the plurality of arch members are separate arch members each having a top portion, a bottom portion opposite the top portion, a first end, a second end opposite the first end, a medial side, and a lateral side opposite the medial side, wherein the lateral side of each of the plurality of arch members is positioned separate from and adjacent to the medial side of the base member, wherein the plurality of arch members includes a first end arch member, a plurality of intermediate arch members, and a second end arch member, wherein the first end of each of the plurality of intermediate arch members and the second end arch member is separate from the second end of each adjacent arch member of the first end arch member and the plurality of intermediate arch members, and wherein each arch member of the plurality of arch members is completely separated from each other arch member of the plurality of arch members when contained within the covering.

* * * * *